US009022440B2

(12) United States Patent
Guidry et al.

(10) Patent No.: US 9,022,440 B2
(45) Date of Patent: May 5, 2015

(54) FISHING GUIDE FOR DIRECTING A SKEWED FISH IN A WELLBORE

(71) Applicant: Baker Hughes Incorporated, Houston, TX (US)

(72) Inventors: Christopher W. Guidry, Spring, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 14/080,408

(22) Filed: Nov. 14, 2013

(65) Prior Publication Data

US 2014/0138969 A1 May 22, 2014

Related U.S. Application Data

(60) Provisional application No. 61/727,420, filed on Nov. 16, 2012.

(51) Int. Cl.

| | |
|---|---|
| ***E21B 31/12*** | (2006.01) |
| ***E21B 31/18*** | (2006.01) |
| ***E21B 31/14*** | (2006.01) |
| ***E21B 31/20*** | (2006.01) |

(52) U.S. Cl.

CPC ..... *E21B 31/18* (2013.01); *E21B 31/14* (2013.01); *E21B 31/20* (2013.01)

(58) Field of Classification Search

CPC ..... E21B 31/12; E21B 31/14; E21B 31/18; E21B 31/20

USPC ..... 294/86.1, 86.11, 86.12, 86.13, 86.14, 294/86.15, 86.16, 86.28, 86.4, 219; 166/98, 166/99, 301

See application file for complete search history.

(56) References Cited

U.S. PATENT DOCUMENTS

| | | | | | |
|---|---|---|---|---|---|
| 750,491 | A | * | 1/1904 | Sargert | 294/86.31 |
| 868,809 | A | * | 10/1907 | Rathbone | 294/86.13 |
| 1,545,830 | A | * | 7/1925 | Hinderliter | 294/86.13 |
| 2,542,445 | A | * | 2/1951 | Young | 166/55.6 |
| 3,173,719 | A | * | 3/1965 | Ringler | 294/86.13 |
| 4,017,113 | A | | 4/1977 | Cullen et al. | |
| 4,580,826 | A | | 4/1986 | Carver et al. | |
| 5,040,283 | A | | 8/1991 | Pelgrom | |
| 6,848,507 | B2 | * | 2/2005 | Huggins et al. | 166/301 |
| 7,455,104 | B2 | | 11/2008 | Duhon et al. | |
| 2004/0262005 | A1 | | 12/2004 | Harmon et al. | |
| 2011/0220346 | A1 | | 9/2011 | Osaland et al. | |

* cited by examiner

*Primary Examiner* — Dean Kramer

(74) *Attorney, Agent, or Firm* — Steve Rosenblatt

(57) ABSTRACT

A guide has an open end and a finger structure preferably of a shape memory alloy. The guide is run in small-diameter configuration through a restriction with a fishing tool, such as an overshot, above it. Once through the restriction, power to heaters on the fingers takes the material past its transition temperature to allow the guide lower end to fan out and surround a skewed fish that is in a slanted position and leaning on a wall of a surrounding tubular that has a larger dimension than the restriction. The bottomhole assembly is then advanced until the fish is captured by the fishing tool and pulled out of the hole. The fingers are forcibly retracted as the assembly is pulled back through the restriction. The guide can use retained fingers with an outward bias to flare out after passing through a restriction, thus acting as a fish guide.

20 Claims, 2 Drawing Sheets

FISHING GUIDE FOR DIRECTING A SKEWED FISH IN A WELLBORE

PRIORITY CLAIM

This application claims priority from U.S. Provisional Patent Application Ser. No. 61/727,420, filed on Nov. 16, 2012, the disclosure of which is incorporated herein by reference in its entirety.

FIELD OF THE INVENTION

The field of the invention is fishing, and more particularly fishing where the fish is sitting skewed in a larger diameter pipe through which the fishing tool has to travel.

BACKGROUND OF THE INVENTION

For a variety of reasons, tools need to be fished out of wellbores either because they are dropped or get stuck or otherwise malfunction. Such tools that need to be retrieved are called "fish." Fishing tools come in two main varieties called spears and overshots. Spears enter the fish to grasp it from the inside, and overshots wash over the outside of the fish to grasp the fish from the outside.

In vertical wellbores or sections of wellbores with a constant diameter running these fishing tools is not normally an issue. However, there are some situations where the fish is in an enlarged position of a wellbore that has restrictions above so that the fishing tool has to travel through the restriction and then capture the fish on the other side of the restriction. The problem arises when the fish is askew and the top of it is against the larger borehole wall. The fishing tool that had to be small enough to traverse the smaller dimension then cannot wash over or get into the skewed fish.

The present invention addresses this issue using a shape memory guide that can be selectively actuated after passing through the restriction so that it achieves a larger dimension to wash over and engage the fish that is positioned against the larger diameter wall below the restriction. One way this is accomplished is to use a shape memory alloy guide that can travel through the restriction and then be selectively actuated to resume a larger dimension when power is supplied to heaters that are on a series of fingers attached to a base ring. The outer dimension of the guide can grow to the point of being able to wedge between the surround tubular and the fish that is leaning against the surround tubular wall.

As mentioned in U.S. Pat. No. 5,040,283, shape memory materials have been deployed in fishing tools in the context of actuation of the shape memory material causes it to revert to another size for physically grabbing the fish. U.S. Pat. No. 7,455,104 uses super-plastic materials in the context of fishing, as shown in FIGS. 5-7, to grab the fish by bending out fingers in a wireline delivered tool that then is grasped by a string in another trip for removal of the fish.

The present invention allows the option of guiding the fish to the spear or overshot that is part of the bottomhole assembly using the guide, which is able to pass through the restriction and selectively engagingly surround the skewed fish so that the fishing tool aligns with the fish and grips it for removal from the wellbore. Those skilled in the art will better appreciate these and other aspects of the invention by a review of the detailed description of the preferred embodiment and the associated drawings, while recognizing that the full scope of the invention is to be found in the appended claims.

SUMMARY OF THE INVENTION

A guide has an open end and a finger structure preferably of a shape memory alloy. Attached to the bottom end of an overshot or spear fishing tool, the guide is run in small-diameter configuration through a restriction. Once through the restriction, power to heaters on the fingers takes the material past its transition temperature to allow the guide's lower end to fan out and form a large-diameter guide that can surround a skewed fish that is in a slanted position and leaning on a wall of a surrounding tubular that has a larger dimension than the restriction. The bottomhole assembly is then advanced until the fish is captured by the fishing tool and pulled out of the hole. The fingers are forcibly retracted as the assembly is pulled back through the restriction. The guide can use retained fingers with an outward bias to flare out after passing through a restriction, thereby acting as a fish guide.

DETAILED DESCRIPTION OF THE PREFERRED EMBODIMENT

Figure 1:
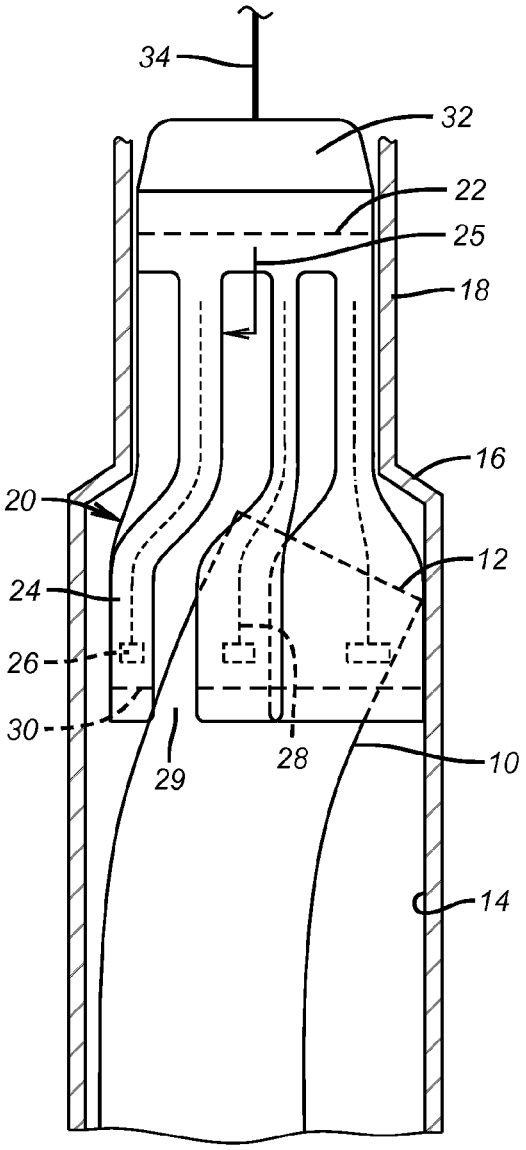
FIG. 1 is a schematic representation of the guide actuated past the restriction and in position to line up the fish for grasping by the fishing tool.

Referring to FIG. 1, the fish 10 is schematically represented as a pipe end but can be a tool or other downhole device positioned askew near its top end 12 against a pipe wall 14 that is located below a transition 16. A smaller diameter tubular 18 is located above the transition 16 so that the diameter of the tubular at 16 is smaller than the diameter at 14. For running in, the guide 20 has a running-in clearance with respect to the restriction or drift diameter of section 18. The guide 20 can have an open base ring or hub 22 from which a plurality of fingers 24 extend axially. As shown, the fingers can be deployed to an extended position when part or all of the length of fingers 24 are below or past the transition 16. The fingers 24 can have initial gaps or develop gaps when moving radially toward wall 14. Alternatively, the fingers 24 can overlap and remain overlapped as they move radially toward wall 14. Fingers 24 define an open passage 29 that starts at the lower end of fingers 24.

Preferably, the fingers 24 are made of a shape memory alloy and each have associated heaters 26 fed by a power wire 28 that can receive power from a local power source, such as a battery, in conjunction with a processor to receive signals from the surface to provide power. Power can also be delivered from the surface when the guide 20 is properly positioned, as in FIG. 1.

Figure 2:
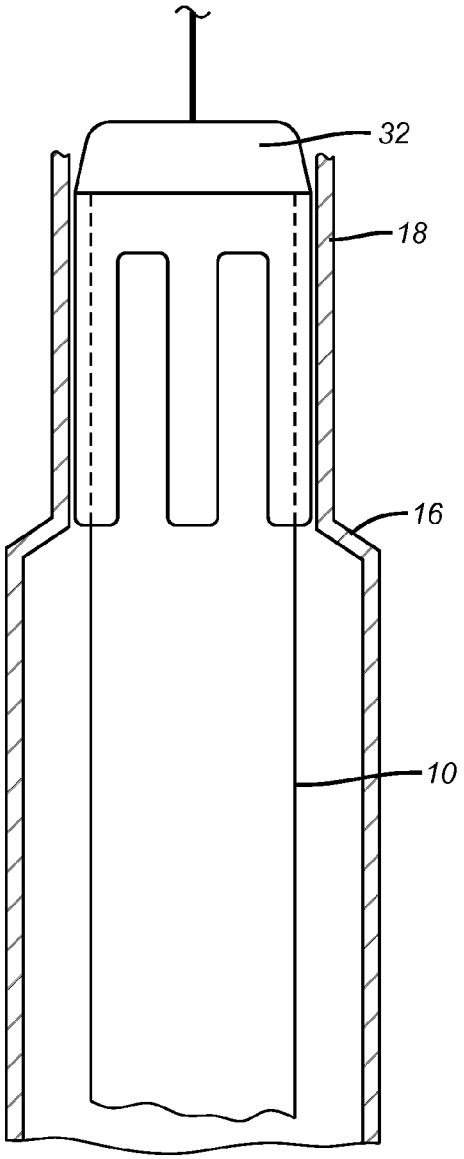
FIG. 2 is the view of FIG. 1, with the fish lined up with the fishing tool and grasped for pulling out of the hole.

Alternatively to the shape memory material, the guide can have fingers 24 of a resilient material with a radially outward bias so that the fingers are retained for run-in and the schematically illustrated retainer 30 is defeated when the guide 20 is at the desired location. The retainer can be actuated to release in a variety of ways, such as, with a timer, by using a surface signal that causes the retainer to release, or with the addition of fluids to the borehole to defeat the retainer. In this alternative, the potential energy retained by the retainer 30 is released so that the fingers 24 can engage the wall 14 and surround the skewed end of the fish 12 to urge the fish 10 to a more centered position so that advancing the guide 20 over the fish 10 will allow the fishing tool 32 to grasp the fish 10, as shown in FIG. 2. The string 34 can then be used to lift the fish 10 from the wellbore. The fishing tool 32 can be a spear or an overshot or any other tool design that can grasp the fish 10 and support it for removal from the wellbore. In another alternative, the guide can further include a mandrel, with a passage therethough to accept the fish 10, and radially extending pistons schematically represented by arrow 25 and actuated in a variety of ways to physically push the fingers 24 radially outwardly to wall 14 and hold them against wall 14 until the fish 10 is captured by the fishing tool 32, at which point the pistons can be retracted to allow the fingers to get through the restriction of tubular 18.

Figure 3:
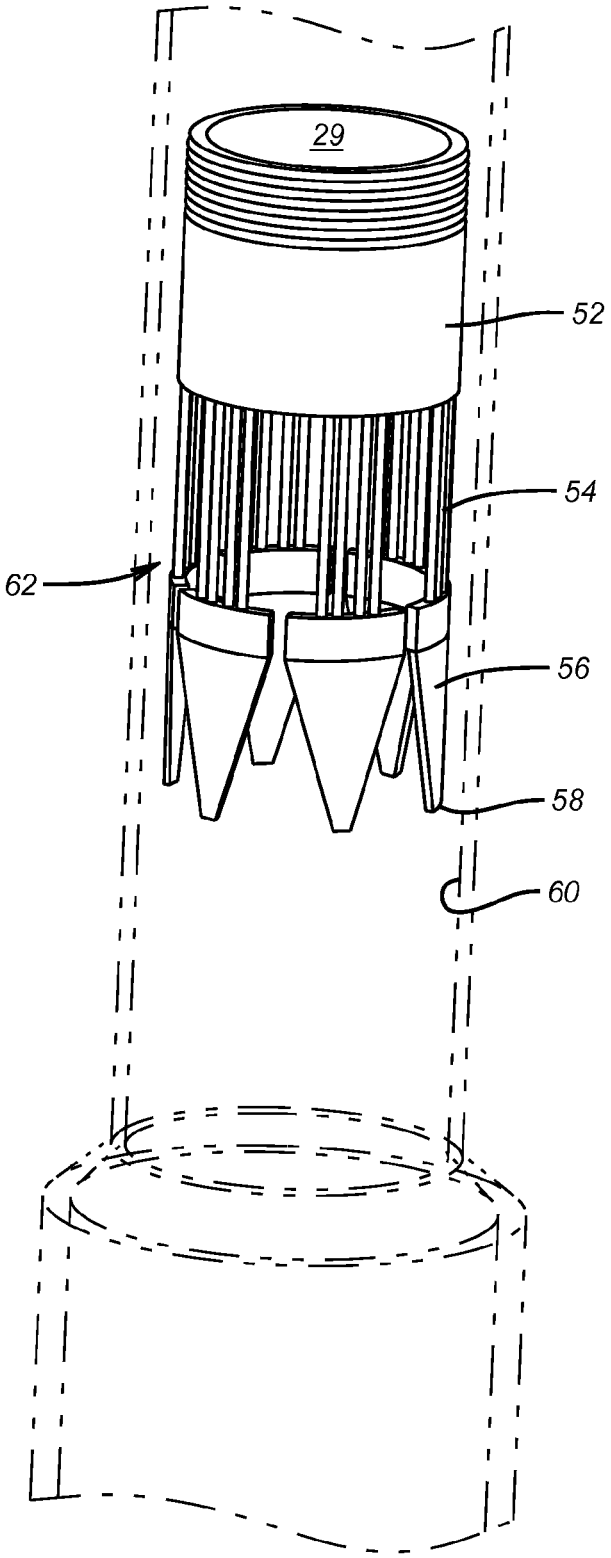
FIG. 3 shows an alternative embodiment of the guide using pointed triangular members at ends of rods that can be actuated to move for alignment of the fish with a fishing tool.

FIG. 3 illustrates an alternative guide 50 that has an open tubular base 52 with axially extending rods 54 that terminate at lower ends in triangular segments that have downwardly oriented points 58 to surround the fish 10 when the rods 54 and the segments 56 are moved outwardly. In one option the rods 54 can be shape memory alloy so that when subjected to heat in the manners described with regard to FIG. 1, the movement is radially outward against the surrounding wellbore wall 60 so that the guide 62 can be advanced over the fish to align it with the fishing tool for removal, as previously described. The segments 56 can optionally be shape memory alloy. The power wires can be run inside the rods 54 if they are hollow or adjacent the exterior of the rods where the heaters can also be located.

Those skilled in the art will now appreciate that the present invention offers a guide that can be run into a larger diameter wall 14 that is below a restriction tubular 18 and the guide can flare out and pry the fish 10 away from wall 14 so that the fish 10 can be channeled into a fishing tool 32 and pulled out with string 34 to the surface. It should be noted that the flaring out can be accomplished with a release of potential energy, such as building a spring bias into fingers 24 or externally biasing the fingers 24 so that when the fingers 24 are at least partially beyond the taper or transition 16, the fingers 24 fan out and still have the structural rigidity to wedge between the wall 14 and the fish 10 to surround the fish 10 and guide it to the fishing tool 32 as the fishing tool 32 is advanced by setting down weight. FIG. 2 indicates that after the fish 10 is engaged by the tool 32, the fingers can be elastically or plastically bent back toward the fish 10 so that they can collapse to a small enough dimension to pass through the tubular 18. An alternative way to flare the fingers 24 toward wall 14 and hold them rigidly extended to surround the fish 10 and guide it is to use a memory material that responds to a stimulus to transform the flared out shape to be serviceable as a guide for the fish 10. Preferably, a shape memory alloy is used and heaters 26 are powered locally or remotely through wires 28. Once the fish 10 is engaged and picked up by the fishing tool 32, after the heat stimulus is removed, the fingers 24 can be deflected, either elastically or plastically, so that the fishing tool 32 and fish 10 can be moved through the transition 16 and tubular 18 restriction.

A retainer 30 can be released to allow the potential energy stored in the fingers 24 to move them radially outwardly. The retainer can be defeated mechanically, chemically, or thermally, among other ways, and preferably after at least a portion of the fingers has passed the transition 16.

The above description is illustrative of the preferred embodiment and many modifications may be made by those skilled in the art without departing from the invention whose scope is to be determined from the literal and equivalent scope of the claims below:

We claim:

1. A fishing guide assembly for recovery of a skewed fish disposed askew in a larger tubular defined by a wall that is accessible by passage through a smaller tubular, comprising:

a fishing tool on a support to allow delivery of the fishing tool to the fish;

a guide mounted to a leading end of said fishing tool and selectively directly actuated by employment of potential energy stored or delivered to at least a portion of said guide not before passing, at least in part, through the smaller tubular whereupon said at least a portion of said guide moves toward a wall of the larger tubular to guide the skewed fish away from the wall and toward said fishing tool for grasping by said fishing tool and removal of the fish through said smaller tubular.

2. The assembly of claim 1, wherein:

said guide comprises fingers that are externally actuated to move toward the wall of the larger tubular.

3. The assembly of claim 1, wherein:

said guide comprises of spaced elongated fingers that move radially outwardly toward the wall of the larger tubular.

4. The assembly of claim 1, wherein:

said guide comprises of overlapping elongated fingers that move radially outwardly toward the wall of the larger tubular.

5. The assembly of claim 1, wherein:

said guide comprises a plurality of fingers that selectively extend to the wall of the larger tubular to guide the fish to the fishing tool as said fingers advance between the fish and the wall.

6. The assembly of claim 1, wherein:

said fishing tool comprises a spear or an overshot.

7. A fishing guide assembly for recovery of a skewed fish disposed askew in a larger tubular defined by a wall that is accessible by passage through a smaller tubular, comprising:

a fishing tool on a support to allow delivery of the fishing tool to the fish;

a guide mounted to a leading end of said fishing tool and selectively actuated after passing, at least in part, through the smaller tubular to move toward a wall of the larger tubular to guide the skewed fish away from the wall and toward said fishing tool for grasping by said fishing tool and removal of the fish through said smaller tubular;

said guide is at least in part made of a memory material that responds to a stimulus to move toward the wall of the larger tubular.

8. The assembly of claim 2, wherein:

said material comprises a shape memory alloy that is responsive to heat to move toward the wall of the larger tubular.

9. The assembly of claim 8, wherein:

said heat is applied through heaters mounted on said fingers.

10. The assembly of claim 9, wherein:

power for said heaters comes from a local or remote source.

11. The assembly of claim 10, wherein:

each of said fingers has a heater mounted thereon.

12. The assembly of claim 8, wherein:

said shape memory alloy is provided in the shape of elongated fingers;

said fingers forcibly retract to enter the smaller tubular with said fishing tool when the fish is engaged.

13. The assembly of claim 12, wherein:

said fingers are spaced apart or overlapping.

14. The assembly of claim 13, wherein:

said heat is applied through heaters mounted on said fingers.

15. The assembly of claim 14, wherein:

power for said heaters comes from a local or remote source.

16. The assembly of claim 15, wherein:

each of said fingers has a heater mounted thereon.

17. The assembly of claim 16, wherein:

said fishing tool comprises a spear or an overshot.

18. A fishing guide assembly for recovery of a skewed fish disposed askew in a larger tubular defined by a wall that is accessible by passage through a smaller tubular, comprising:

a fishing tool on a support to allow delivery of the fishing tool to the fish;

a guide mounted to a leading end of said fishing tool and selectively directly actuated by employment of potential energy stored or delivered to at least a portion of said guide after passing, at least in part, through the smaller tubular whereupon said at least a portion of said guide moves toward a wall of the larger tubular to guide the skewed fish away from the wall and toward said fishing tool for grasping by said fishing tool and removal of the fish through said smaller tubular;

said guide comprises fingers that store said potential energy that is retained by a retainer that is defeated to release said stored potential energy.

19. The assembly of claim 18, wherein:

said retainer comprises a band surrounding said fingers that is defeated mechanically, chemically, or thermally to release said stored potential energy.

20. A fishing guide assembly for recovery of a skewed fish disposed askew in a larger tubular defined by a wall that is accessible by passage through a smaller tubular, comprising:

a fishing tool on a support to allow delivery of the fishing tool to the fish;

a guide mounted to a leading end of said fishing tool and selectively actuated after passing, at least in part, through the smaller tubular to move toward a wall of the larger tubular to guide the skewed fish away from the wall and toward said fishing tool for grasping by said fishing tool and removal of the fish through said smaller tubular;

said guide comprises fingers that are externally actuated to move toward the wall of the larger tubular;

said fingers are extended with pistons that selectively extend radially from a hub having a passage therethrough through which the fish extends as said fishing tool is advanced toward the fish.

* * * * *